US005607381A

United States Patent [19]

Endelman

[11] Patent Number: 5,607,381

[45] Date of Patent: Mar. 4, 1997

[54] EXERCISE APPARATUS

[76] Inventor: Ken Endelman, 7500-14th Ave. #23, Sacramento, Calif. 95820-3539

[21] Appl. No.: 676,936

[22] Filed: Jul. 8, 1996

Related U.S. Application Data

[62] Division of Ser. No. 225,502, Apr. 11, 1994, which is a continuation of Ser. No. 940,495, Sep. 4, 1992, abandoned.

[51] Int. Cl.[6] ..... A63B 21/04

[52] U.S. Cl. ..... 482/142; 482/908; 482/94; 482/129

[58] Field of Search ..... 482/10, 94, 140, 482/142, 145, 904, 908, 121, 122, 123, 124, 129, 130; 297/391, 406, 410

[56] References Cited

U.S. PATENT DOCUMENTS 3,269,768 8/1966 Kinney ..... 482/142

5,364,327 11/1994 Graham ..... 482/129

5,441,473 8/1995 Safani et al. ..... 482/130

FOREIGN PATENT DOCUMENTS 3134902 3/1983 Germany ..... 482/140

*Primary Examiner*—Stephen R. Crow

*Attorney, Agent, or Firm*—John R. Wahl; Holland & Hart

[57] ABSTRACT

An exercise apparatus utilizing a platform which is slidable on a frame. The platform moves on the frame against a resistance force provided by a spring connected to the platform and the frame. A foot support connects the frame and includes a contact surface which is adjustable along first and second dimensions.

6 Claims, 2 Drawing Sheets

EXERCISE APPARATUS

This application is a division of Ser. No. 08/225,502 filed Apr. 11, 1994 which is a continuation of Ser. No. 07/940,495, filed Sep. 4, 1992, now abandoned.

BACKGROUND OF THE INVENTION

The present invention relates to a novel and useful exercise apparatus.

Many exercise apparatuses have been proposed to rehabilitate or develop different muscles of the body. In addition, exercise apparatuses have use resistance devices such as weights and springs against which the user pulls or pushes, using the arm and leg portions of the body.

Reference is made to U.S. Pat. No. 1,621,477 which describes a gymnastic apparatus using a set of weights connected to a wheeled platform which moves on a track. The user lies down on the platform and pushes against the frame with his feet by gaining support at the shoulders and hands by structures which extend upwardly from the platform. Unfortunately the apparatus shown in the U.S. Pat. No. 1,621,477 patent is not susceptible to use by persons of different heights or physical abilities.

An exercise apparatus using a slidable platform which is adjustable to accommodate persons of different heights would be a notable advance in the physical therapy field.

SUMMARY OF THE INVENTION

In accordance with the present invention a novel and useful exercise apparatus is herein provided.

The exercise apparatus of the present invention utilizes a sliding platform which is movable on a frame against a resistance force. The frame may provide a pair of rails and the platform may include wheels to ride on such rails. The resistance force may be provided by weights, springs or other similar items. In any case, the resistance force element, such as a spring, is connected to the platform and may span the platform and frame member.

The frame includes a pair of stanchions connected by a standing rail system which may also serve as a sliding surface for the platform. One of the stanchions may be constructed with a pair of arms which extend upwardly from a base portion and are separated from one another by a gap or hiatus which is of sufficient size to permit passage or movement of the head of the user through the same. Cables fix to the platform and extend through a pulley system to hand or first straps which are gripped by the user. In addition, shoulder rests are constructed to extend outwardly from the platform.

The apparatus of the present invention also includes a foot support which is connected to the frame or, in certain embodiments, from a stanchion of the frame. The foot support includes foot contacting surface and a mounting member for supporting the same. The foot contacting surface may be embodied in a bar, a plate, a pair of plates individually positionable, and the like. First support means is also provided for adjustably holding the foot support along a first dimension. Likewise, second support means is also included for adjustably holding the foot support along the second dimension. The first and second support means dimensions may includes horizontal and vertical components.

It may be apparent that a novel and useful exercise apparatus has been described.

It is therefore an object of the present invention to provide an exercise apparatus which utilizes a sliding platform and requires the user to push the platform against a resistance force in the form of a spring member.

Another object of the present invention is to provide a exercise apparatus using a sliding platform movable against a resistance force which is adjustable to persons of different height and physical abilities, while using a foot support element capable of being multi-positioned relative to the user.

Yet another object of the present invention is to provide an exercise apparatus which is compact and easy to assemble and use.

A further object of the present invention is to provide an exercise apparatus which employs a sliding platform and a multiplicity of supports permiting the use of the exercise apparatus in various therapeutic situations.

The invention possesses other objects and advantages especially as concerns particular characteristics and features thereof which will become apparent as the specification continues

Figure 1:
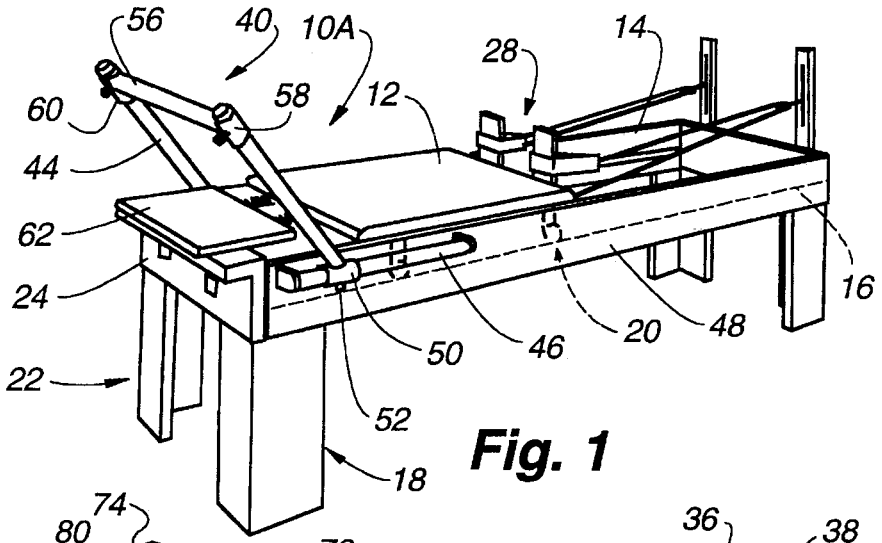
FIG. 1 is a top right, perspective view of an embodiment of the apparatus of the present invention.

For a better understanding of the invention reference is made to the following detailed description of the preferred embodiments thereof which should be referenced to the prior described drawings.

DESCRIPTION OF THE PREFERRED EMBODIMENTS

Various aspects of the present invention will evolve from the following detailed description of the preferred embodiments thereof which should be referenced to the hereinabove described drawings.

The apparatus as a whole is depicted in the drawings by reference character 10 and an upper case letter to denote multiple embodiments. Apparatus 10A utilizes a platform 12 which is intended to support a sitting, standing or reclining user. Platform 12 slides on rails 14 and 16 which are positioned within a frame 18. Platform 20 may slide directly on rails 14 and 16 or through the use of plurality of wheels 20 (shown in phantom FIGS. 1–3). Frame 18 is supported above the floor surface by legs 22. Frame 18 is also constructed with an end piece 24. Multiplicity of springs 26 connect to platform 12 and end piece 24 such that platform 12 moves away from end piece 24, against a resistance force provided by springs 26.

Platform 12 is also provided with a pair of shoulder rests 28 which extend upwardly from platform 12. A pair of end loops 30, shown encircling rests 28, are connected to a pair of lines 32. Lines 32 past through a pair of pulleys 34 which are connected to posts 36 and 38 affixed to frame 18. Lines 32 then extend into connection with platform 12. Thus, pulling of loops 30 by the user's hands or feet will tend to move platform against the resistance force afforded by plurality of springs 26.

Figure 2:
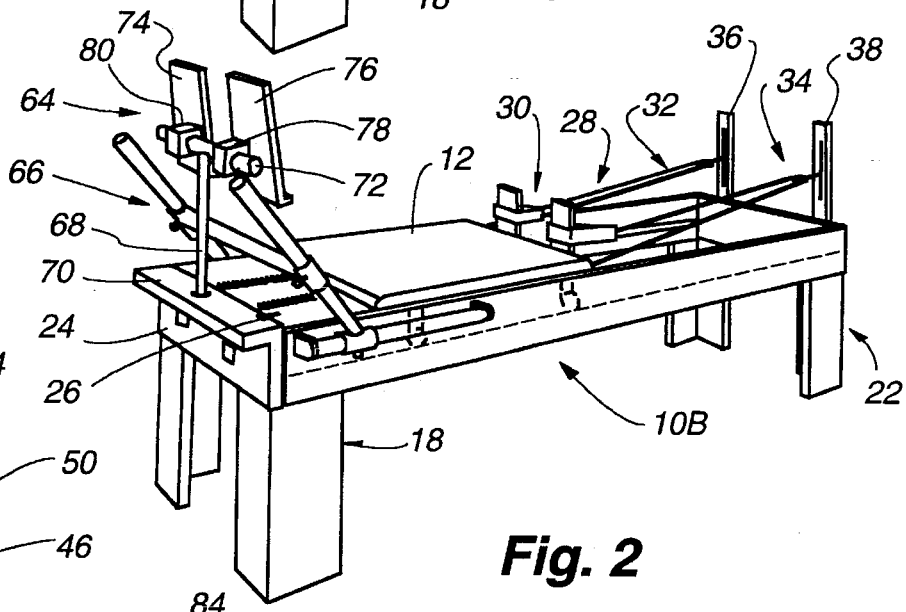
FIG. 2 is a top right, perspective view of an embodiment of the apparatus of the present invention showing particular foot support.
Figure 3A:
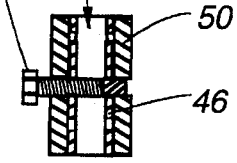
FIG. 3A is a sectional view of a particular adjustment mechanism for the foot supports depicted in FIGS. 1–3.
Figure 3:
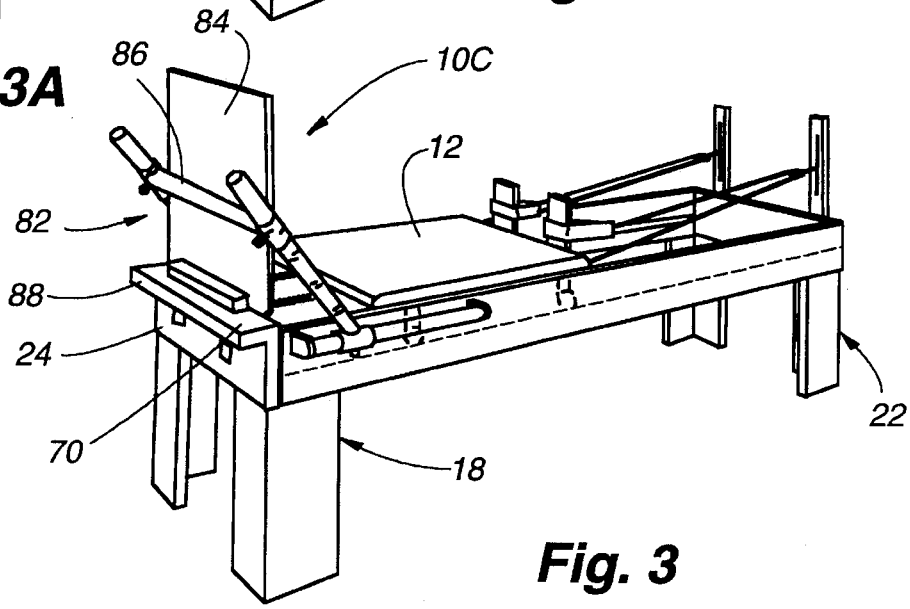
FIG. 3 is a top, right, perspective view of an embodiment of the apparatus of the present invention showing another type of foot support.

The apparatuses 10A, 10B, and 10C are identically constructed in FIGS. 1–3 with the exception of particular adjustable foot supports. With respect to the foot support 40 of apparatus 10A, FIG. 1, a pair Of elongated elements 42 and 44 extend upwardly from horizontal bar 46 and another identical horizontal bar (not shown) which are affixed to side piece 48 of frame 18. Elongated element 42 is identically constructed to elongated element 44. Thus, the discussion hereinafter with respect to elongated element 42 would be applicable to the construction of a elongated element 42. Elongated element 42 terminates in a bushing 50 which slides over horizontal bar 46. Bushing 50 includes a set bolt 52 which fits into any number of a plurality of openings 54 through horizontal bar 46, FIG. 3A. Thus, elongated element 42 and 44 may be moved back and forth horizontally and fixed to a certain position by set bolt 52. In addition, a spanning bar 56 is adjustably fixed to elongated elements 42 and 44 by end bushings 58 and 60, which are fixed by set bolts in a manner similar to bushing 50, illustrated in Fig. 3A. Namely, spanning bar 56 may move along elongated elements 42 and 44, a movement which includes a vertical component. Plate 62 allows the user to rest his feet when spanning bar 56 is not employed as a foot support.

Turning now to FIG. 2, apparatus 10B includes a foot support mechanism 64, in addition to a foot support mechanism 66 which is identical to foot support mechanism 40 of apparatus 10A, FIG. 1. Foot support mechanism 64 includes a rod 68 which extends through flange 70 of end piece 24. Rod 68 connects to a cross piece 72 having a pair of foot plates 74 and 76 which fasten to rotatable blocks 78 and 80. Rotatable blocks, although permitted to rotate about cross piece 70 are held tightly thereto by a friction fit.

With reference now to apparatus 10C, FIG. 3, foot support 82 is depicted as being identical to foot support 40 found on embodiment 10A of FIG. 1. In addition, flattened member 84 is illustrated as being attached to spanning bar 86. Brace block 88 lies across flange 70 of end piece 24 to aid in the support of flattened member 84 when the same is contacted by the feet of the user of apparatus 10C. Flattened member 84 may be transparent to permit observation of the foot contact makes with flattened member 84.

Figure 4:
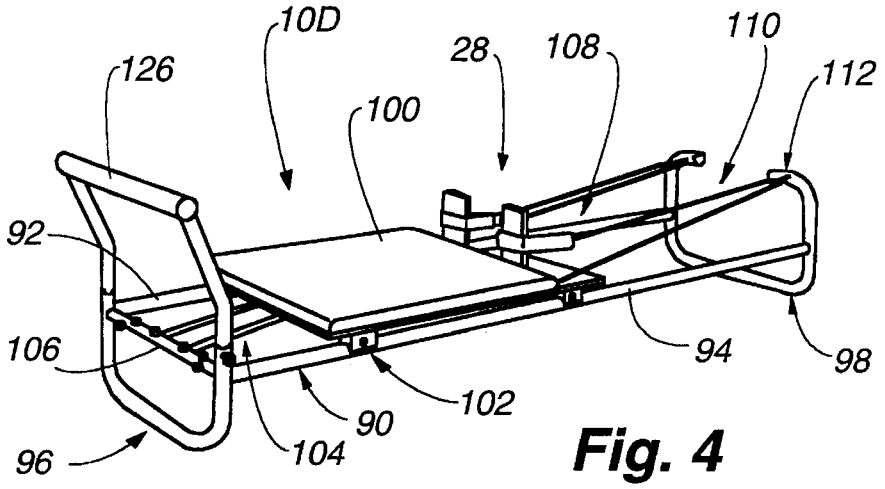
FIG. 4 is a top right, perspective view of an embodiment of the exercise apparatus of the present invention showing yet another foot support.

FIG. 4 represents a further embodiment 10D of the apparatus of the present invention. Apparatus 10D includes a frame 90 formed of metallic tubing. Frame 90 is constructed with longitudinal members 92 and 94 which are welded or otherwise connected to end pieces 96 and 98. Platform 100 rides along longitudinal member 92 and 94 by the use of plurality of casters 102. Multiplicity of springs 104 fasten to platform 100 and cross bar 106 of end piece 96. Pairs of hand loops 108, lines 110 and pulleys 112 are similar to the loop, line, and pulley combination described in FIG. 2 with regard to embodiment 10B.

Figure 5:
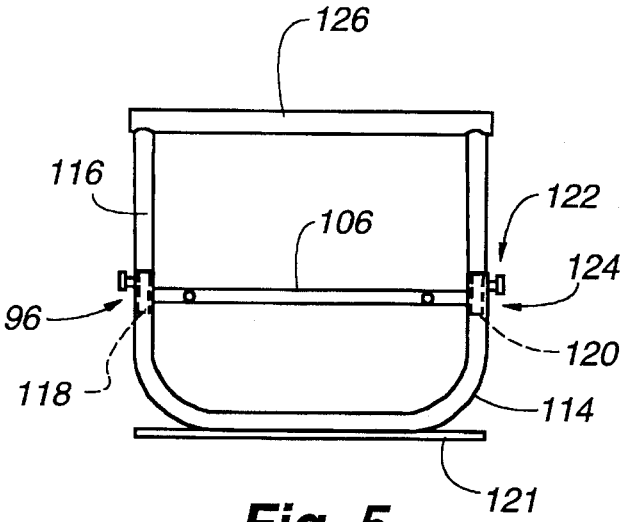
FIG. 5 is a left end view of the exercise apparatus depicted in FIG. 4.
Figure 5A:
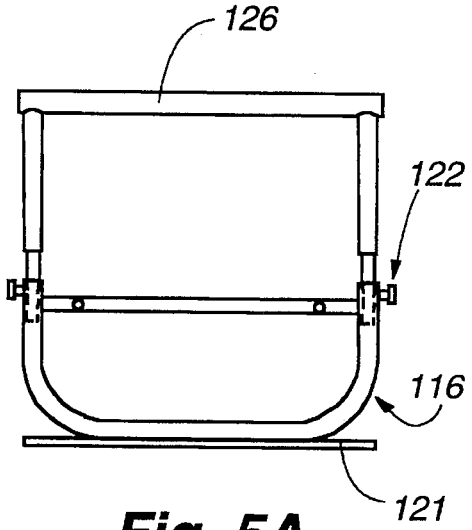
FIG. 5A is a left end view of the exercise apparatus depicted in FIG. 4 showing an extended foot support position.

Now viewing FIGS. 5 and 5A, end piece 96 includes a base member 114 spanned by cross bar 106 of the upper portion thereof. Upper portion 116 is roughly U-shaped and includes a pair of bosses 118 and 120 which telescopically nest within the ends of hollow base 114. Base 114 rests on ground surface 121. Pair of locking bolts 122 pass through the hollow ends of base 114 and engage a plurality of openings 124 (shown schematically in FIG. 5 and 5A) to determine the height of bar 126 of upper piece 116. Bar 126 is shown at a higher level in FIG. 5A than in FIG. 5.

Figure 6:
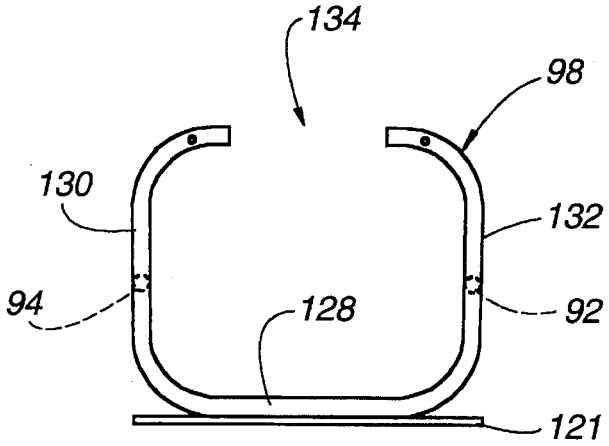
FIG. 6 is a right end view of the exercise apparatus of FIG. 4.

FIG. 6 depicts end piece 98 which includes a horizontal element 128 and a pair of arms 130 and 132 extending therefrom. Arms 130 and 132 do not meet, but form a gap 134 which is of sufficient dimension to allow the head of the user lying on platform 100 to pass through the same when the feet of the user contact bar 126.

In operation, the user lies down platform 12 of embodiments 10A, B, or C and engages loops 30 with the user's hands or feet while gaining support from shoulder rests 28. Loops 30 are then pulled to move platform 12 against the resistance force of springs 26. The user's feet are either placed on bar 56 of apparatus 10A, foot plates 74 and 76 of apparatus 10B, or flattened member 84 of embodiment 10C. In the latter case, flattened plate 84 may be constructed of transparent material such that an observer may ascertain the foot pressure placed on flattened member 84 by each foot of the user. The height of bar 56 and flattened member 84 may be adjusted by means typically illustrated in FIG. 3A. Thus, apparatus 10A, B or C may accommodate users of different heights. With reference to apparatus 10D depicted in FIGS. 4–6, the user again lies on platform 100, engages hand or foot loops 108, and pulls against plurality of springs 104. Platform 100 then travels along longitudinal members 92 and 94. The user's feet rest on bar 126 which is adjustable by the mechanism described in FIGS. 5 and 5A to accommodate users of different heights.

While in foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. An exercise apparatus comprising:

a frame having a pair of spaced parallel track members;

a movable platform adapted to ride on said parallel track members for supporting at least a portion of a user's body; and at least one stretchable resistance member connected between said platform and said frame, said platform being movable along said track members by a user exerting a force, between said platform and said frame;

wherein said frame further comprises a head end portion and a foot end portion, said foot end portion extending from one end of each of said parallel track members, said foot end portion having a pair of upwardly open spaced sockets and a removable, generally U shaped, foot support member in said sockets, said foot support member having a transverse bar portion and a pair of spaced parallel legs extending from said transverse bar portion, each of said legs having a free end adapted to removably fit into one of said sockets, each of said legs having an identical bend therein between said free end and said transverse bar portion separating each leg into spaced parallel straight portions, whereby the horizontal position of said transverse bar portion above said track members is changeable between a first horizontal position and a second horizontal position by reversing the free ends of said legs in said sockets.

2. The apparatus according to claim 1 wherein each of said free ends of said foot support member has a plurality of axially aligned tranverse through bores and each of said sockets having a set of transverse holes adapted to receive a retaining pin in said holes and through said bores to selectively position said transverse bar portion at different heights above said track members.

3. The apparatus according to claim 2 wherein each said free end has three through bores.

4. The apparatus according to claim 2 further comprising said head end portion having a pair of spaced, upwardly extending arms, each of said arms supporting a pulley above said track members adapted to carry a line having one end connected to said platform and an opposite end extending through said pulley, whereby a user can move said platform along said track members against said resistance member by pulling on said line.

5. An exercise apparatus utilizing, in combination, a frame having a pair of spaced, parallel, generally horizontal longitudinal track members and a platform slidable along said longitudinal members against a resistance force, the improvement comprising:

said frame including head and foot end portions, said head end portion having a pair of spaced, upwardly extending arms, each of said arms supporting a pulley adapted to carry a line having one end connected to said platform and an opposite end extending through said pulley to a hand loop, whereby a user resting on said platform and pulling on at least one of said hand loops, moves said platform along said longitudinal members against said resistance force;

said foot end portion including a base member having a pair of spaced apart, upwardly extending ends each forming a socket therein, and a removable foot bar member having a transverse foot bar portion and a pair of spaced parallel legs, each of said legs ending in a boss adapted to nest within one of said sockets, said legs each having an identical bend therein so that said foot bar portion may be positioned at two different horizontal positions in a single parallel plane above said horizontal longitudinal frame members by reversing said bosses in said sockets.

6. The apparatus according to claim 5 wherein each of said bosses has a plurality of axially spaced holes therethrough and each of said sockets has a transverse hole therethrough adapted to receive a retaining pin therein, said retaining pin removably fitting through said transverse hole and through one of said axially spaced holes in said boss so that said foot bar portion may be removably fixed at different heights above said longitudinal frame members.

* * * * *